United States Patent [19]

Keesey et al.

[11] Patent Number: 4,929,141

[45] Date of Patent: May 29, 1990

[54] BALE-OPENING METHOD AND APPARATUS

[75] Inventors: Charles R. Keesey, Sanderson; Ted C. Flood, Jacksonville, both of Fla.

[73] Assignee: International Baler Corp., Jacksonville, Fla.

[21] Appl. No.: 312,276

[22] Filed: Feb. 21, 1989

[51] Int. Cl.[5] ..... B65B 69/00; B65G 65/02

[52] U.S. Cl. ..... 414/412; 53/381 R; 83/909; 414/766

[58] Field of Search ..... 414/412, 421, 419, 766, 414/778, 783; 83/909; 53/381 R, 492; 29/426.3, 426.4, 564.3

[56] References Cited

U.S. PATENT DOCUMENTS

| | | | |
|---|---|---|---|
| 2,820,282 | 1/1958 | Schneider, Jr. | 83/909 |
| 3,071,258 | 1/1963 | Seigh et al. | 414/766 |
| 4,592,698 | 6/1986 | Semp et al. | 29/564.3 X |
| 4,610,596 | 9/1986 | Bouldin et al. | 414/412 |
| 4,838,751 | 6/1989 | Hanaya et al. | 83/909 X |

*Primary Examiner*—Sherman D. Basinger

*Attorney, Agent, or Firm*—Wolder, Gross & Bondell

[57] ABSTRACT

A method for removing packaging from a cotton or similar bale comprises delivering the bale to a first station and fixing the bale in position at the station. A cutter mechanism is driven along the length of the bale to cut the bale strips. The bale is then released and passed to a second station where the strapping and a portion of the wrappings are removed. The bale is then passed to a third station where the bale is rotated 180 degrees about a transverse axis. The bale is passed to a fourth station where the remaining wrappings are removed. The bale is then transferred to a fifth station where the bale is made available for further processing of the cotton.

8 Claims, 5 Drawing Sheets

BALE-OPENING METHOD AND APPARATUS

The present invention relates to a new and improved method and apparatus for the removal of baling wire or strapping and the like, as well as wrapping materials for baled goods, such as raw cotton.

The manufacture of cotton thread and fabric naturally begins with the harvesting of raw cotton from cotton plants. This raw cotton is normally compressed into bales approximately 60 inches long, 20–28 inches wide, and 30–32 inches high and weighing several hundred pounds. The baled cotton is normally covered with a burlap or polyester wrapping, secured in place by longitudinal metal strapping. So packaged, the raw cotton is delivered to a facility which begins conversion of the raw cotton into textile products. Upon receipt at such a facility, the wrappings must be removed to allow access to the cotton fibers.

Traditionally, this has been a labor-intensive process, with manual labor utilized to cut the strapping or bale wire and remove both the strapping and wrap. In addition to being time-consuming, traditional methods have been highly dangerous, as the strapping, when cut with snippers or an axe, often recoils explosively from the bale, hitting the workers and inflicting injury.

It is accordingly the purpose of the present invention to provide a method and apparatus for the removal of bale wrapping materials in which manual labor is minimized. By use of the present invention, production economies can be achieved, and worker injuries resulting from the unbaling process are significantly reduced.

The present invention incorporates a series of work stations along which a cotton bale is passed by a suitable conveying system. The bale is positioned at the first station where the locations of the straps are sensed and then cut by an automated mechanism. The bale then passes to the next station where an operator removes the cut straps and the exposed top portion of the bale wrap. The bale then moves to a third station which inverts the bale to allow the remaining wrap to be exposed. The bale is then passed to a fourth station where the operator may remove the remaining balé wrap, thus fully exposing the cotton. The bale is then further passed to a fifth collection station which gathers subsequently processed bales for loading onto a pallet, cart or other transportation means so that the cotton may then be transported for further processing.

A fuller understanding of the invention will be accomplished upon consideration of the following description of a preferred, but nonetheless, illustrative embodiment of the invention when taken in conjunction with the annexed drawings, wherein.

Figure 1:
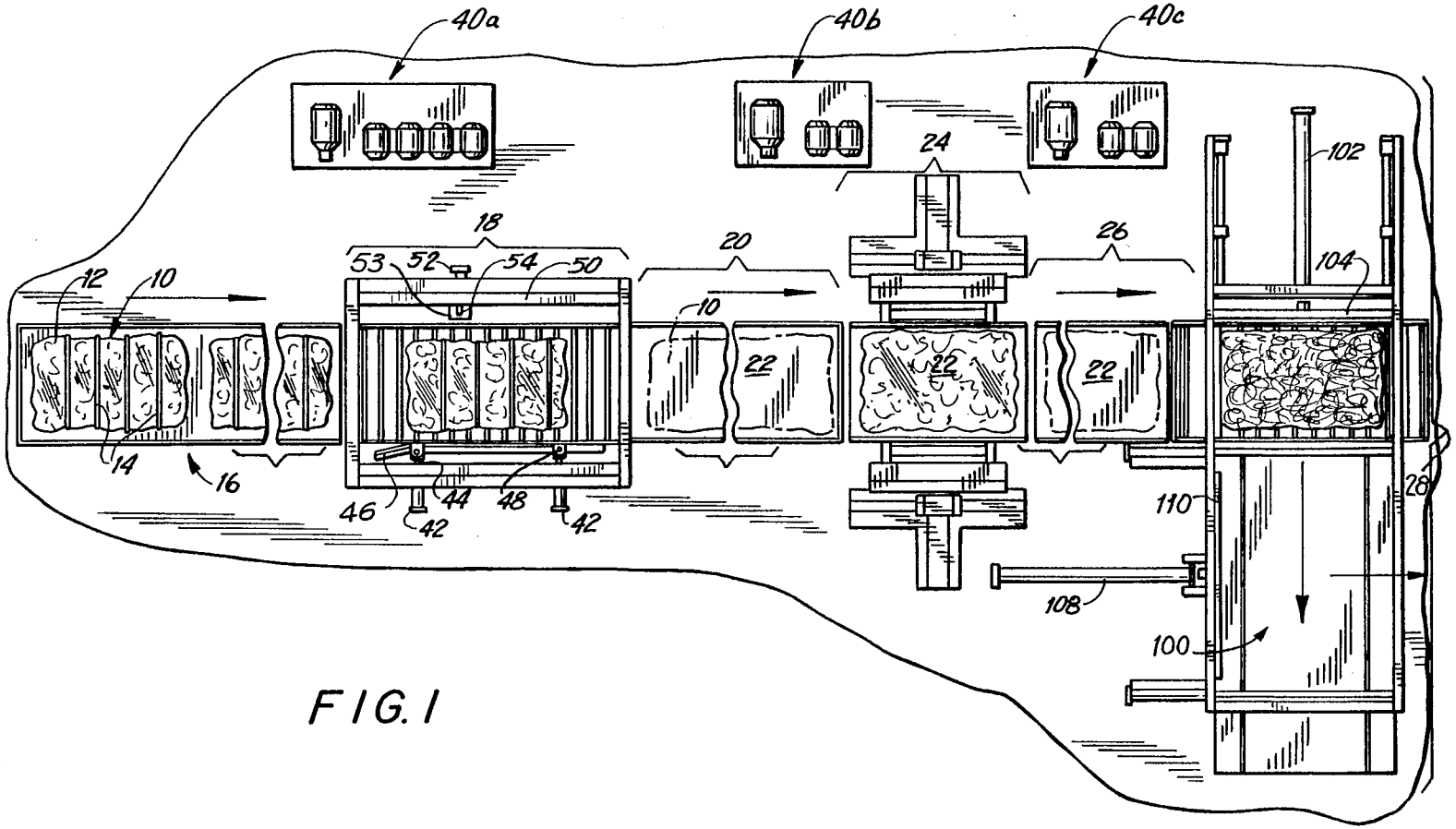
FIG. 1 is a top plan view of the apparatus of the present invention.
Figure 2:
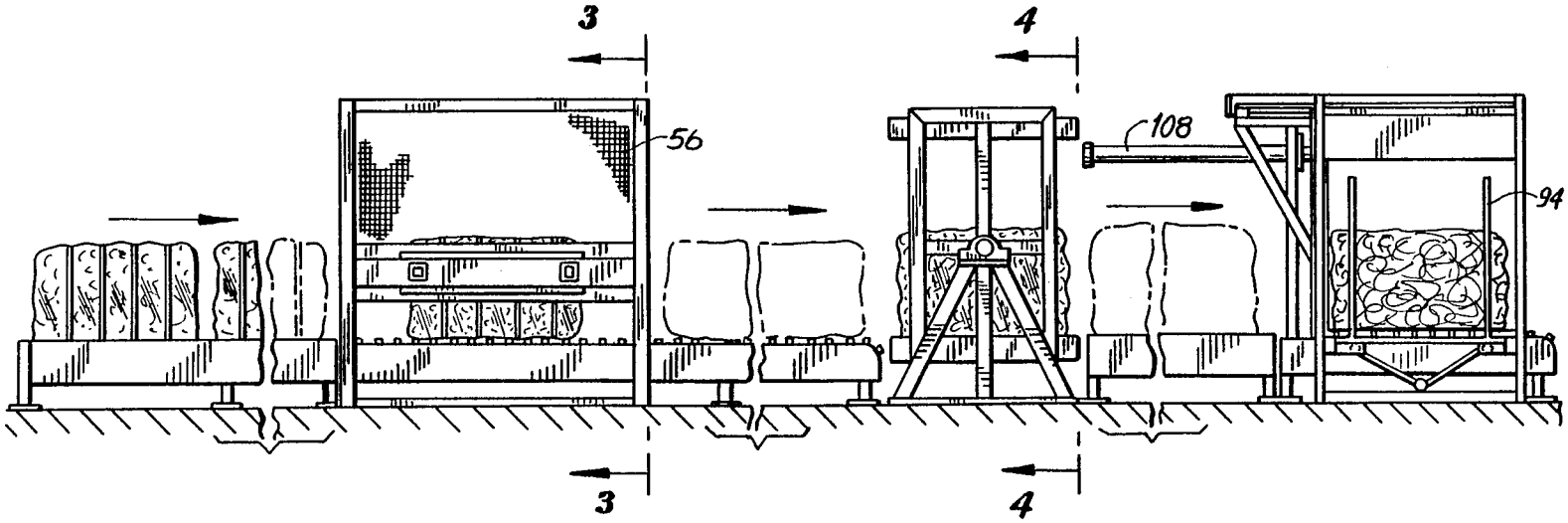
FIG. 2 is a side elevation view of the apparatus.

Referring to the Figures and initially FIGS. 1 and 2 thereof, cotton bales 10 having a burlap or polyester wrap 12 secured in place by transverse bands 14 are loaded on input conveyor 16 for delivery to first station 18, where the positions of bands 14 are sensed and the bands severed along a side of the bale. The bale is then passed to second station 20 where the split bands are manually removed along with the exposed top portion of the wrapping 12, thus exposing the upper portion of the cotton mass 22. The partially unwrapped bale 10 is then passed to a third station 24, which comprises a flipping unit which rotates the bale top-for-bottom, exposing the remaining portion of the wrap 12. The bale is then passed to fourth station 26, at which point the operator removes the remaining wrapping, thus fully exposing the cotton mass 22. The naked bale is then transferred to fifth station 28, which collects a group of three processed bales and allows them to be transferred to a waiting pallet, hand-truck or the like, for delivery for further processing.

Figure 3:
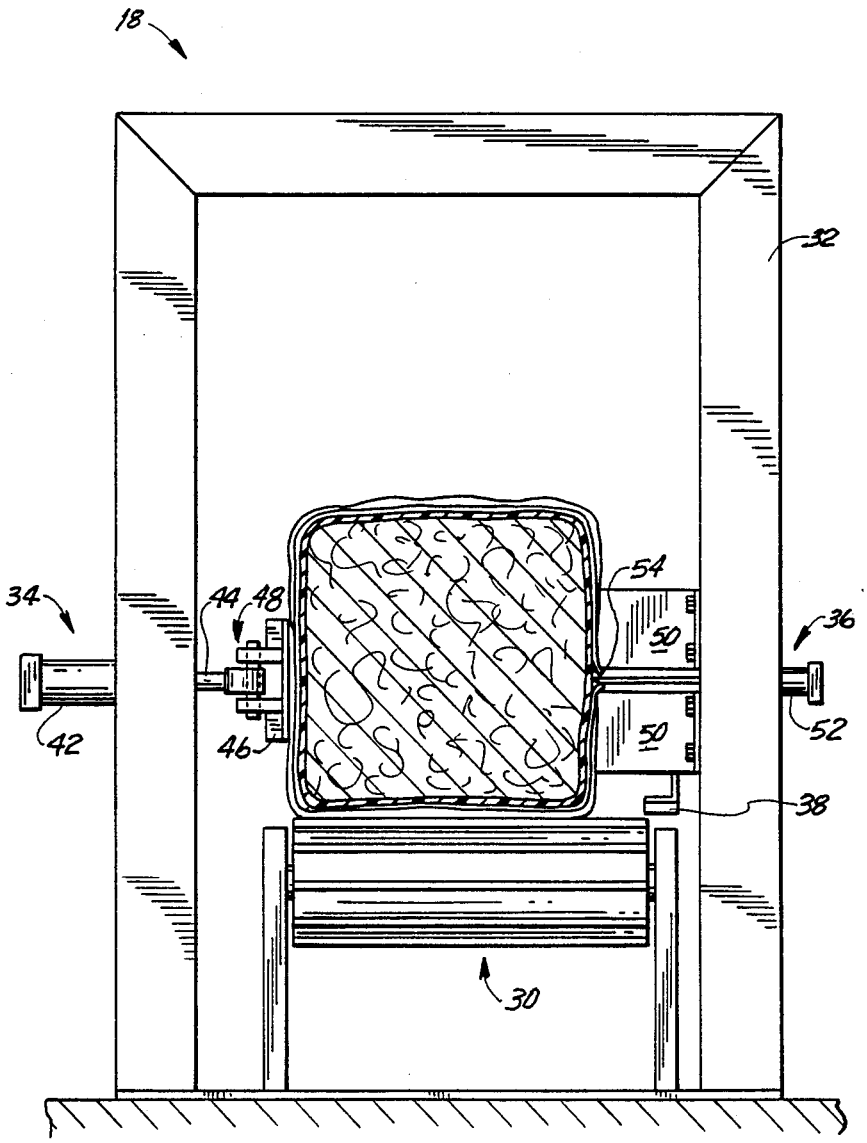
FIG. 3 is an elevational view taken along line 3—3 of FIG. 2 detailing the first station of the apparatus.

Referring to FIGS. 1–3, first station 18 includes a conveyor 30 along which the bales 10 travel. Frame 32, which is of standard construction, supports a hydraulically-operated backing unit 34 and cutter unit 36 positioned on opposite sides of the passing bales 10. When a bale enters station 18, photocell 38, which is positioned towards the downstream end of the station, and which is connected to appropriate logic circuitry, senses the position of the front edge of the bale and stops conveyor 30, such that it is positioned between cutter 36 and backing unit 34. At that time, backing unit 34 is energized by remote power unit 40*a*.

Backing unit 34 consists of a pair of drive cylinders 42 positioned to drive pistons 44 transversely towards the side of the bale 10, holding the bale against the opposite side 50 of the frame. Longitudinal pressure plate 46 is affixed to the ends of the pistons 44 by clevis pin assemblies 48, and when pistons 44 are extended, presses against and maintains the bale 10 in the correct longitudinal position on conveyor 30 against the action of cutter unit 36. As may be seen in FIG. 1, pressure plate 46 is provided with an angled front portion to help guide any misaligned bales back on to the conveyor 30.

Cutter unit 36 includes transversely mounted hydraulic cylinder 52 which drives blade 54 into the bale 10 as required to pierce the bands 14. Cutter cylinder 52 and blade 54 are mounted on a pair of longitudinal tracks (not shown) which extend along the length of frame 32, and are driven by an appropriate driver (not shown) coupled to power unit 40 along the tracks, down the length of the bale. A metal detector (53) is located in register with the blade 54, and senses the position of a band 14 as the cutter unit 36 travels along the length of the bale. When a band 14 is sensed travel is halted and cutter cylinder 52 is energized, driving the blade 54 into the bale through the band, severing the band so that it may be subsequently removed from the bale. After piercing the band the blade 54 is retracted, and the cutter unit continues down the length of the bale to pierce the other bands. Once the cutter has reached the end of its travel it returns to the start position. Pressure plate 46 is then retracted from the bale side of cylinder 42 and conveyor 30 is energized to permit the bale to be passed to second station 20. The sides and top of the frame 32 are covered with metal mesh 56 to prevent the severed bands 14 from flying out and possible injury therefrom.

When the bale is at second station 20, conveyor 30, which forms a part of both the first and second station apparatus, is again halted. The pierced bands 14 are then manually removed from the bale, along with portions of the wrapping 12 which are no longer held against the cotton bale inwards by the bands 14. Conveyor 30 is a conventional slat-type unit, the longitudinal slats facilitating clearance for removal of the bands from the bales. It is to be recognized that as conveyor 30 passes through both stations 18 and 20, a first bale 10 may be passed to the second station 20 for band removal while a second bale 10 enters first station 18 for band slitting. When each station is full, bales can be processed at a rate of approximately 60 per hour.

Figure 4:
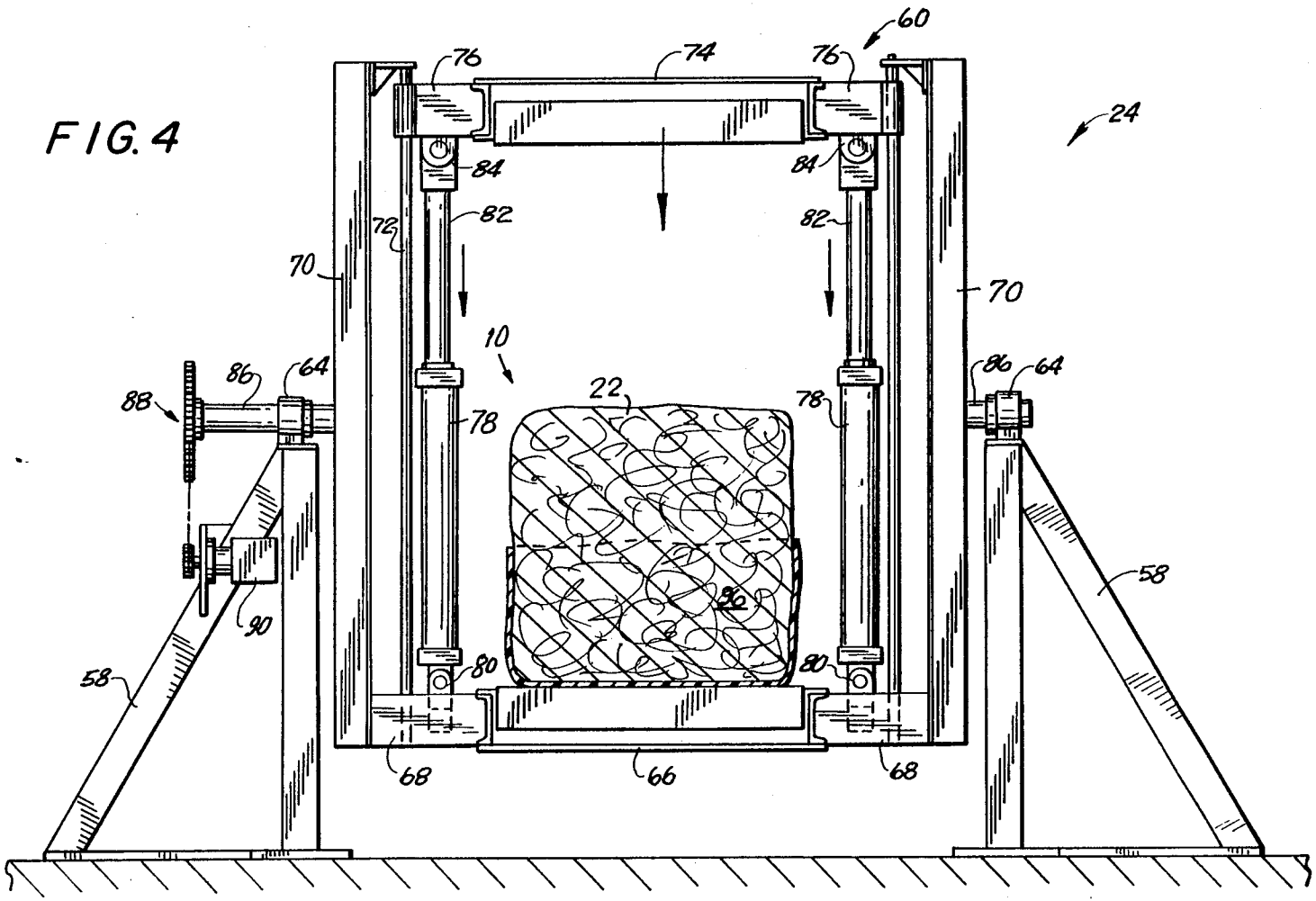
FIG. 4 is an elevation view taken along 4—4 of FIG. 2 detailing the fourth station of the apparatus.

After the bands and a portion of the wrap is removed, the bale 10 passes to third station 24, which may be best seen in FIG. 4. As shown therein, station 24 comprises pivoting carriage unit 60 mounted for rotation about a central axis. The carriage is supported upon opposed frame units 58 having bearing collars 64 mounted to the tops thereof.

Rotating carriage 60 includes a first affixed conveyor unit 66 supported by frame base elements 68. Vertical frame elements 68 support vertical way-bars 72, to which second, movable conveyor unit 74 is mounted by collar sections 76 for vertical travel. Positioning of the second conveyor 74 is controlled by hydraulic cylinders 78 mounted to base elements 68 by pivot joints 80, whose pistons 82 are connected to collar section 76 by pivot joints 84. The cylinders are driven by remote power source **40*b*. Opposed axle segments 86, affixed to the central vertical frame elements 70, are journaled for rotation in bearings 64. A gear train 88, driven by motor 90**, allows the unit to rotate as required.

Figure 7:
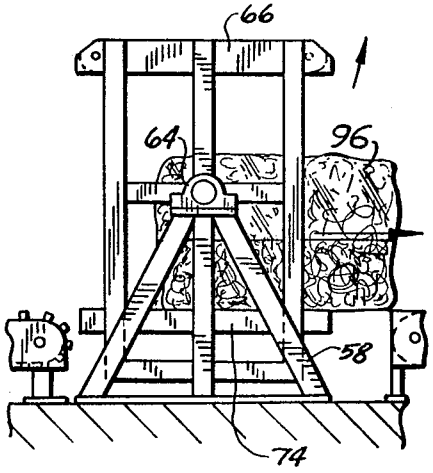
FIGS. 5 through 7 are diametric representations of successive steps in the operation of the apparatus of the fourth station.
Figure 6:
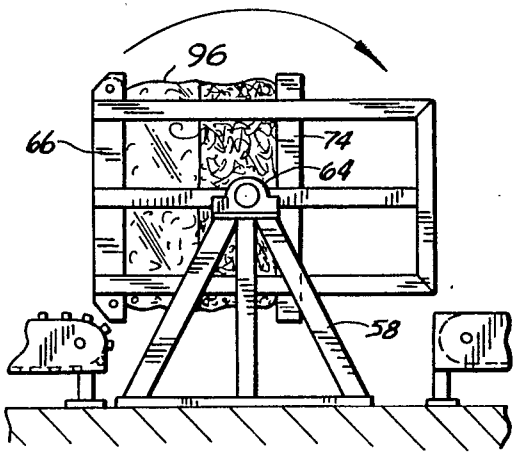
Figure 5:
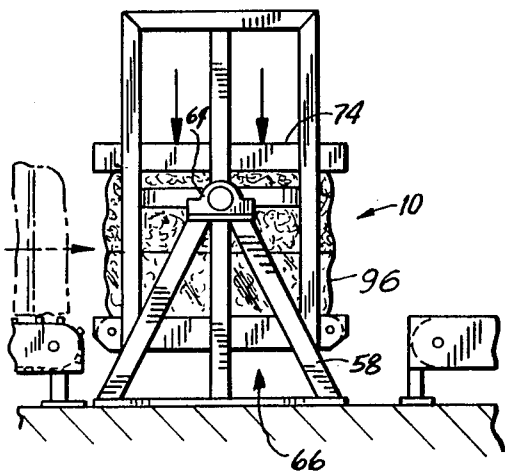

As may be seen in FIGS. 5 through 7, a bale 10 having the partially exposed cotton mass 22 is received within carriage unit 60 from dive conveyor 30. This bale has a portion 96 of the wrapping 12 remaining about its lower section. When the bale is within the carriage, cylinders 78 are activated to retract pistons 82, whereby upper conveyor 74 is lowered into contact with the top surface of the bale. With such contact being maintained, retaining the bale in position, the carriage 60 undergoes a 180° rotation, as depicted in FIG. 6. When the inverted orientation of FIG. 7 is reached, cylinders 78 are activated to extend pistons 82. This lowers conveyor 74, on which the bale 10 now rests, into alignment with conveyor 30 and the following conveyor 98. The bale has now been inverted, with the remaining portions 96 of the wrap being fully exposed. The bale is then transferred to fourth station 26, as seen in FIG. 1, where this remaining wrapping is removed manually. From here, the now fully naked bale is passed to fifth station 28.

Fifth station 28 includes the continuation of conveyor 30, which transports the bales from wrap-removal fourth station 26 to a position whereby they may be passed to collection platform 100. Hydraulic cylinder 102, driven by power unit **40*c*, drives pusher-bar 104, which contacts a side of the naked bale 22 on conveyor 30 and drives it onto platform 100 until it is in contact with stop-rods 94, as best seen in FIG. 2. Pusher-bar 104 is then retracted to await the passage of another naked bale 22 onto conveyor 30. When such a bale arrives, cylinder 102 is again activated, and the bale is directed onto platform 100 until it lies adjacent to the previously-positioned bale. This procedure is repeated until three bales are aligned on the platform. At that time, hydraulic cylinder 108 is activated, driving pusher-bar 110 into contact with an end of the bales, which are then removed from platform 100 and are loaded onto a cart or similar transfer means. After the bales are removed from the platform, the pusher-bar 110** retracts, thus allowing another set of three bales to be loaded on the platform.

We claim:

1. A method for removing packaging from a cotton or similar bale when the bale is covered by such packaging in the form of sheet-like wrappings bound by a plurality of straps, comprising the steps of:

delivering the bale to a first station;

fixing the bale in position at said first station;

driving a cutter mechanism along the length of the bale, whereby the bale straps are cut;

releasing the bale and passing the bale to a second station;

removing the strapping and a portion of the sheet-like wrappings from the bale;

passing the bale to a third station;

rotating the bale 180° about a transverse axis;

passing the bale to a fourth station;

removing the remaining sheet-like wrappings from the bale; and passing the bale to a fifth station, whereby the bale is made available for further processing of the cotton contained therein.

2. The process of claim 1, wherein said cutter-driving step includes the further steps of sensing the position of a bale strap, positioning a strap-cutting knife proximate the sensed position, directing the cutting knife from a retracted position through the bale strap to cut the strap, and withdrawing the knife to the retracted position.

3. The process of claim 2, wherein the sensing step is performed by a metal proximity detector device.

4. An apparatus for the removal of sheet and band bale wrappings comprising a first conveyor onto which the bales sought to be unwrapped are loaded; a strapping cutter station located at the end of said first conveyor to accept the bale from said first conveyor, wherein the bale strapping is cut; a strapping-removal station located adjacent said strapping cutting station whereas the strapping and a portion of the sheet-wrap are removed from the bale; an inversion station located adjacent said strapping-removal station, wherein the bale is rotated 180° about a longitudinal axis; a wrap-removal station located adjacent said inversion station whereat the remaining wrapping is removed from the bale; a transfer station located adjacent said wrap-removal station, wherein the bale is positioned for loading upon delivery means for transfer for further processing; and conveyor means located and adapted to transfer the bales to and between said stations.

5. The apparatus of claim 4, wherein said strapping cutting station includes means for rigidly positioning the bale and means for positioning a knife for selective cutting of the bale straps.

6. The apparatus of claim 5, wherein said positioning means includes a carriage mounted for travel along the length of a bale positioned in the cutting station, said carriage supporting a strap sensor and means for extending a knife through the strap into the bale to cut the strap at the location sensed by said sensor and withdrawing the knife from the bale to permit the carriage to be positioned proximate another strap.

7. The apparatus of claim 6, wherein said strap sensor is a metallic proximity sensor.

8. The apparatus of claim 6, wherein said strapping-removal station includes a conveyor upon which the bale is supported.

* * * * *